United States Patent [19]

Odham

[11] Patent Number: 4,870,839

[45] Date of Patent: Oct. 3, 1989

[54] APPARATUS FOR DEKNITTING ELASTIC YARNS

[75] Inventor: Carl J. Odham, Asheboro, N.C.

[73] Assignee: Asheboro Elastics, Corp., Asheboro, N.C.

[21] Appl. No.: 136,858

[22] Filed: Dec. 22, 1987

[51] Int. Cl.[4] ..... D04B 15/50; D04B 19/00

[52] U.S. Cl. ..... 66/125 A; 28/218; 66/203

[58] Field of Search ..... 66/125 R, 125 A, 203, 66/213; 28/218, 170, 171

[56] References Cited

U.S. PATENT DOCUMENTS

| | | | |
|---|---|---|---|
| 6,152 | 3/1849 | Higgins et al. | 26/27 |
| 2,169,886 | 8/1939 | Shaw | 28/194 |
| 2,297,881 | 10/1942 | Fuller | 28/170 |
| 2,596,246 | 5/1952 | Johnson et al. | 66/203 X |
| 2,654,936 | 10/1953 | Slovin | 28/170 X |
| 2,837,808 | 6/1958 | Langlois et al. | 28/170 |
| 3,336,645 | 8/1967 | Mirsky | 28/166 |
| 3,466,718 | 9/1969 | Adamson | 28/218 X |
| 3,542,267 | 11/1970 | Ida et al. | 28/170 X |
| 3,547,329 | 12/1970 | Kalwaites | 28/170 X |
| 3,720,984 | 3/1973 | Roberson, Jr. | 28/218 |
| 3,918,135 | 11/1975 | Kim | 66/125 R X |
| 4,761,864 | 8/1988 | Berger et al. | 28/218 |

FOREIGN PATENT DOCUMENTS

| | | | |
|---|---|---|---|
| 478707 | 5/1975 | Australia | 66/125 R |
| 4629911 | 8/1971 | Japan | 28/218 |
| 5011506 | 5/1975 | Japan | 66/125 R |

*Primary Examiner*—Robert R. Mackey

*Attorney, Agent, or Firm*—Rhodes and Coats

[57] ABSTRACT

An apparatus and method for feeding a knitted yarn package having a plurality of yarn ends to a textile fabric making machine. The apparatus includes takeup means for moving the yarn in the direction of the machine and tension means located upstream of the takeup means for providing resistance to the movement of the yarn in the direction of the machine. An unravelling assembly is positioned between the takeup means and the tension means for engaging the yarn ends. The unravelling assembly is operable to uniformly unravel the knitted yarn package.

34 Claims, 2 Drawing Sheets

APPARATUS FOR DEKNITTING ELASTIC YARNS

BACKGROUND OF THE INVENTION

The present invention relates in general to textile machines, such as a machine for knitting narrow elastic, which utilize a knitted yarn package in the form of a continuous, unravellable strip and in particular to a new and novel apparatus for uniformly unravelling the knitted yarn package and for applying substantially uniform and constant tension to the unravelled yarn ends being fed to the machine.

Typically, textile machines for making narrow elastic fabric receive and knit together a plurality of elastic and conventional yarn ends from a number of individual yarn packages mounted on large creel frames adjacent to the machine. In order to reduce the floor space for the yarn supply arrangement and, in addition, to improve the efficiency and ease of transporting the yarn, it has become a common practice to knit a plurality of elastic yarn ends into a compact knitted yarn package which must be deknitted during the feeding operation. Examples of such yarn packages are illustrated in U.S. Pat. Nos. 3,827,261, 4,411,142 and 4,569,212. These methods of handling yarn have proven especially useful for elastic yarn, such as spandex, which may shrink, take a permanent set, or distort the yarn package during storage when handled conventionally, thereby presenting problems of nonuniform tension, snarling, and the like when the yarn is fed to the textile fabric making machine.

However, the use of knitted yarn packages of highly elastic yarns of relatively high denier has resulted in undesirably low feeding speeds which can cause significant economic losses over a period of time in view of the capital investment in a modern, high-speed, textile fabric forming machine since the unacceptable slow speed of deknitting such yarns does not permit the operator to take full advantage of the production capacity of the machine.

One prior art device for feeding and unravelling a knitted yarn package is illustrated in U.S. Pat. No. 3,542,084. A separate advancing mechanism passes the strip from the knitted yarn package through a pair of feed rolls. The motor driving the rolls is controlled by a relay activated by an electrically conductive finger which rests above the advancing yarn strip and a grounded bracket below the yarn strip. When the yarn unravels past the point where it is no longer between the finger and bracket, the relay is activated, thereby causing the motor to turn the feed rolls.

Certain disadvantages become apparent with such a design. First, if used with a yarn package having a plurality of ends, a single, incompletely unravelled yarn end could prevent the finger from contacting the bracket, thereby preventing the feed rolls from advancing the knitted yarn package. Second, no means are provided for controlling the tension as the strip is advanced. Third, no means are provided for adding tension over the amount necessary to cause the knitted yarn package to unravel. Finally, the design, as shown in FIG. 3 of the '084 patent, is not easily adaptable for feeding a modern textile fabric forming machine which is capable of using a plurality of knitted yarn packages and, consequently, would require a number of feeders for each textile machine.

Another well-known apparatus which has previously been adapted for feeding knitted yarn packages is illustrated in U.S. Pat. No. 2,920,772. This apparatus, commonly referred to as a "mousetrap", includes a plurality of parallel pins aligned perpendicular to the direction of movement of the knitted yarn package as it moves towards the textile fabric making machine. The pins are mounted alternately to an upper, pivoting member and a lower, stationary base member. The knitted yarn package is then passed between the plurality of pins. Tension is added by adding weight to the upper pivoting member to cause the pins mounted thereto to press against the moving knitted yarn package, thereby increasing the resistance to movement of the knitted yarn package.

Another device which is somewhat similar to the "mousetrap" is commonly referred to as a "ladder". This device also includes a plurality of parallel pins; however, unlike the "mousetrap", the pins are arranged similarly to rungs on a ladder. The knitted yarn package is then threaded over and under as many "rungs" as needed to provide sufficient tension to unravel the knitted yarn package.

Certain disadvantages are also apparent with both of these designs. First, no means are provided for ensuring uniform tension across the width of the knitted yarn package resulting in one or more yarn ends being under more or less tension than the other. Thus, the amount of these "latitudinal" tension variations may cause the fabric produced by, for example, a knitting machine, to skew since the amount of tension through one portion of the fabric may differ from the remainder of the fabric.

Second, no means are provided for controlling the tension in the direction of movement of the knitted yarn package after the tension initially has been set. Thus, minor changes in the textile fabric making machines's feed speed may result in differences in the amount of this "longitudinal" tension that may cause the pick count of the finished fabric to fall outside of prescribed limits. Furthermore, larger changes in the feed speed may result in "breakout" (i.e., the amount of tension exceeds the breaking strength of the yarn end) or "blow-up" (i.e., the amount of tension is less than the force needed to unravel the knitted yarn package and some incompletely unravelled yarn ends actually enter the textile fabric making machine).

It has thus become desirable to develop an apparatus for feeding a knitted yarn package having a plurality of yarn ends to a textile machine for knitting narrow elastic fabric that will uniformly unravel the knitted yarn package. In addition, it has become desirable to develop an apparatus for feeding a knitted yarn package that will apply substantially uniform and constant tension to the yarn ends being fed to the machine even if the speed of the machine changes. Finally, it has become desirable to develop such an apparatus which is simple to install, use, and maintain.

SUMMARY OF THE INVENTION

The present invention solves the aforementioned problems associated with the prior art by providing an apparatus for feeding a knitted yarn package having a plurality of yarn ends to a textile fabric machine which is operable to uniformly unravel the knitted yarn package and to apply substantially uniform and constant tension to the yarn ends being fed to the machine. The apparatus includes a support member attached upstream of the textile fabric making machine and generally perpendicular to the direction of movement of the yarn ends towards the machine. Means are attached to the support member for engaging the yarn ends prior to the yarn ends being absorbed by the machine. The engaging means enhances the unravelling of the yarn ends and, consequently uniformly unravels the knitted yarn package.

In the preferred embodiment, the apparatus includes a ribbon guide for receiving the knitted yarn package from its feed container. A pair of parallel pins is located adjacent to and downstream from the ribbon guide and perpendicular to the direction of movement of the knitted yarn package towards the machine for receiving the knitted yarn package and providing frictional resistence to the movement of the knitted yarn package towards the textile machine. A cylinder having a plurality of radially mounted bristles is rotatably mounted downstream from the pair of pins and aligned perpendicular to the direction of movement of the yarn ends for engaging the surface of the plurality of yarn ends being fed to the textile machine. A belt drive connects the cylinder to the feed rolls of the textile machine and is configured to cause the cylinder to rotate in a direction opposite to the movement of the yarn ends towards the textile machine. The contact of the bristles with the yarn ends causes the knitted yarn package to unravel uniformly. In addition, the direct drive connection between the cylinder and the textile machine provides for substantially uniform and constant tension of the yarn ends being fed to the machine since a change in the speed of the machine results in a proportional change in the speed of rotation of the cylinder.

Accordingly, one aspect of the present invention is to provide an apparatus for feeding a knitted yarn package to a textile fabric making machine which is operable to apply substantially uniform and constant tension to the knitted yarn package.

Another aspect of the present invention is to provide an unravelling assembly for an apparatus for feeding a knitted yarn package, having a plurality of yarn ends, to a textile fabric making machine which is operable to uniformly unravel the knitted yarn package.

Still another aspect of the present invention is to provide an apparatus for feeding a knitted yarn package, having a plurality of yarn ends, to a textile fabric making machine which is operable to both apply substantially uniform and constant tension to the yarn ends being fed to the textile machine and to uniformly unravel the knitted yarn package.

These and other aspects of the invention will be more clearly understood after a review of the following description of the preferred embodiment of the invention when considered with the drawings.

DESCRIPTION OF THE PREFERRED EMBODIMENTS

Figure 1:
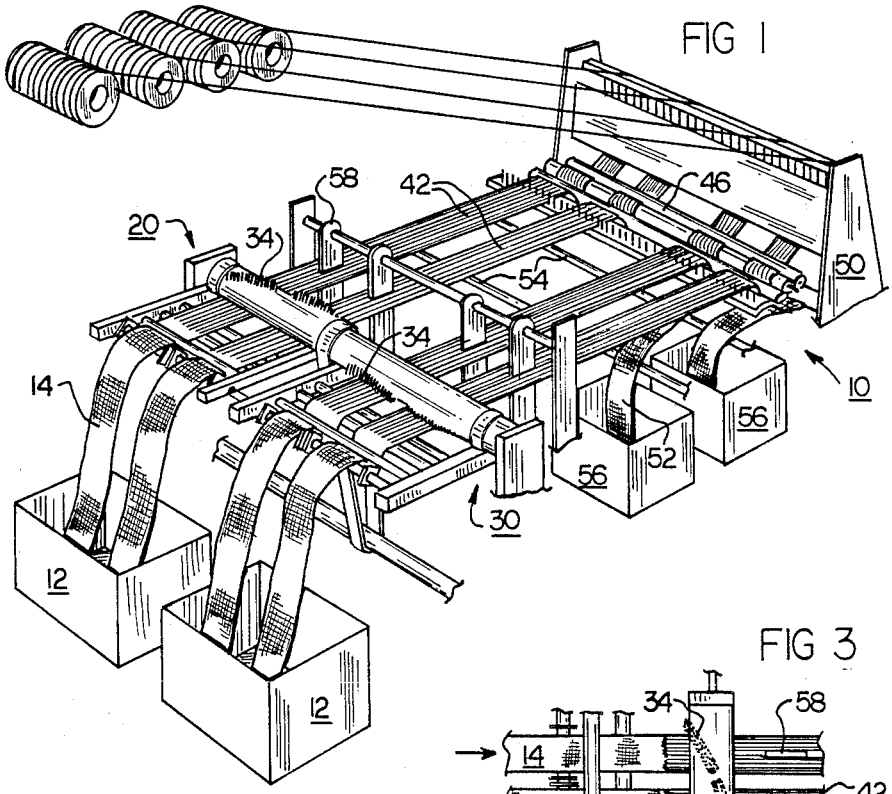
FIG. 1 is a perspective view of a textile fabric making machine which uses knitted yarn packages illustrating the location of the feeding mechanism of the present invention.

Referring now to the drawings, it will be understood that the illustrations are for describing a preferred embodiment of the invention and are not intended to limit the invention thereto.

As best seen in FIG. 1, a conventional textile machine for making fabric, generally designated 10, is shown. Textile fabric making machine 50 can be any of a number of conventional textile fabric making machines, for example, narrow elastic knitting machines. Feed cartons 12 contain knitted yarn packages 14 which are supplied to a feeding mechanism, generally designated 20. Feeding mechanism 20 includes an unravelling assembly, generally designated 30 to unravel the knitted yarn package 14 into yarn ends 42. Yarn ends 42 are received by nip rolls 46 and fed into textile fabric making machine 50. Fabric 52 exits textile machine 50 is taken up by delivery rolls 54 and fed to takeup containers 56.

The feeding mechanism 20 of the present invention, as embodied herein, is operable to uniformly unravel knitted yarn package 14. In addition, it applies substantially uniform and constant tension to the yarn ends 42 being fed to textile machine 50.

Figure 2:
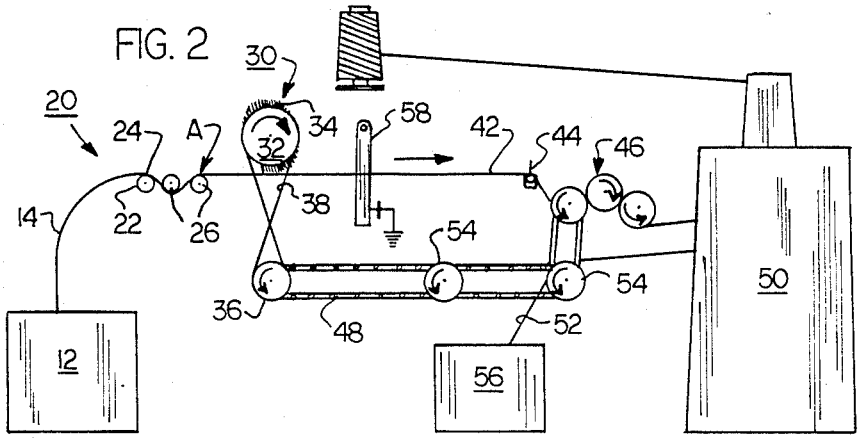
FIG. 2 is a diagramatic side view of the feeding mechanism of FIG. 1.
Figure 4:
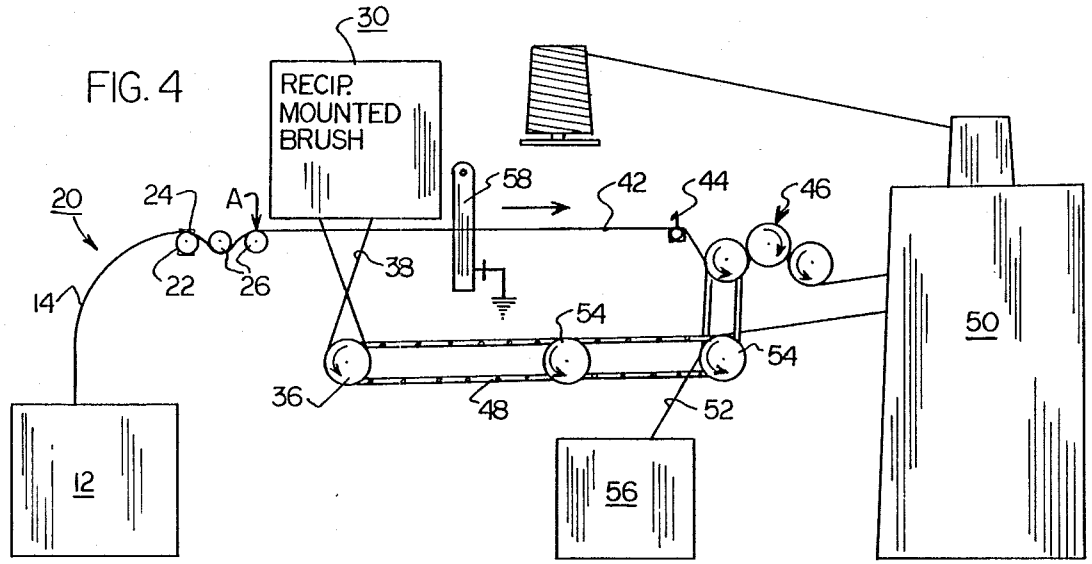
FIG. 4 is a diagrammatic side view of an alternative embodiment of the mechanism of FIG. 1.

Referring to FIG. 2, guide bar 22, tension pins 26, unravelling assembly 30, and guide bar 22 receives knitted yarn package 14 from feed container 12 to facilitate alignment of the knitted yarn package with feeding mechanism 20. Feeding mechanism 20 actually consists of three subassemblies: tension pins 26; unravelling assembly 30; and nip rolls 46. In the preferred embodiment, a pair of tension pins 26 are utilized, however, additional pins could be used to provide additional tension as needed. Tension pins 26 provide frictional resistance to the movement of knitted yarn package 14 towards knitting machine 50. Unravelling assembly 30 is located downstream of tension pins 26 and is rotatably mounted in a line perpendicular to the direction of movement of yarn ends 42. Unravelling assembly 30 is configured to frictionally engage the yarn ends 42 as they pass from tension pins 26 through reed 44 and are taken up by nip rolls 46. Unravelling assembly 30 includes one or more rows of bristles 34 radially mounted on cylinder 32. Cylinder 32 is driven by means of elastic belt 38 which is connected to drive sprocket 36. In the preferred embodiment, drive sprocket 36 is connected by chain drive 48 to delivery rolls 54 and, in turn, delivery rolls 54 are connected to nip rolls 46. By this arrangement changes in the speed of nip rolls 46 are directly transmitted through drive sprocket 36 and, subsequently, by belt 38 to rotatable cylinder 32, thereby changing the speed of rotation of unravelling assembly 30 in proportion to the change in speed of nip rolls 46.

Figure 3:
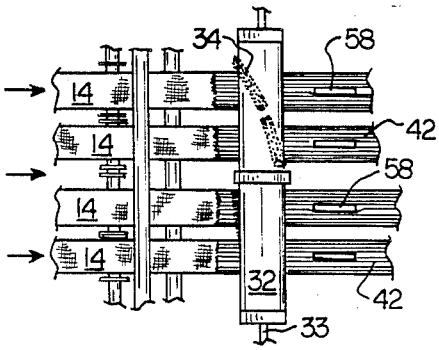
FIG. 3 is an enlarged top view of the feeding mechanism of FIG. 1.

Turning to FIG. 3, a top view of the feeding mechanism of the subject invention is shown. Ribbon guides 24 are movable along guide bar 22 to align knitted yarn package 14 with brushes 34 on roll 32. In the preferred embodiment, roll 32 is mounted on a shaft 33 thereby providing means for rotation. In addition, brushes 34 are radially mounted around roll 32, as shown, in order that only one segment of brushes 34 is contacting yarn ends 42 at any time, thereby providing less drag and smoother operation. Conventional stop motion means 58 may be positioned downstream of unravelling assembly 30 to provide additional protection in the event that yarn ends 42 do not completely unravel, due, for example, to belt 38 breaking. In operation, knitted yarn package 14 is pulled from feed container 12 by the action of nip rolls 46. As knitted yarn package 14 passes over guide mechanism 22, it is aligned with tension pins 26. Knitted yarn package 14 then passes over and under tension pins 26 as the yarns are absorbed by textile machine 50. As knitted yarn package 14 exits from tension pins 26, unravelling assembly 30 is arranged to frictionally engage the surface of the yarn ends passing underneath it. Drive belt 36 is arranged to cause roll 32 to rotate in a direction opposite to the movement of the yarn ends 42. When bristles 34 engage the surface of yarn ends 42, the contact results in the knitted yarn package 14 uniformly unravelling as the yarn package 14 exits tension pins 26 near point "A". In addition, since drive sprocket 36 is directly connected to nip rolls 46 by means of chain drive 48 and delivery rolls 54, any changes in the speed of textile machine 50 result in a proportional change in the speed of rotation of roll 32, thereby applying substantially uniform and constant tension to the yarn ends being fed to textile machine 50.

Certain modifications and improvements will occur to those skilled in the art by reading the foregoing description. By way of example, additional rows of bristles 34 could be added to roller 32. In addition, other means for engaging the yarn ends other than bristles 34 could also be employed. For example, wiper blades or beater bars could also be utilized. In addition, such means do not necessarily have to be mounted on a rotatable roll. For example, unravelling assembly 30 could also be a reciprocally mounted brush. It should be understood that all such modifications and improvements have been deleted herein for the sake of preciseness and readability but are properly within the scope of the following claims.

I claim:

1. An apparatus for feeding and unravelling a knitted elastic yarn package to a textile fabric making machine under substantially uniform and constant tension comprising:

(a) takeup means for moving the yarn ends of the package in the direction of the machine;

(b) tension means for providing resistance to the movement of the yarn package in the direction of the machine;

(c) an unravelling assembly positioned between said takeup means and said tension means for movably engaging the yarn ends; and (d) drive means connected to said unravelling assembly for moving said unravelling assembly with respect to said yarn ends in a direction opposite to the direction of movement of the yarn ends towards the machine;

whereby the moving engagement of said assembly with the yarn ends is operable to unravel the knitted yarn package uniformly.

2. The apparatus according to claim 1, wherein said takeup means includes at least one pair of nip rolls connected to and driven by said textile fabric making machine.

3. The apparatus according to claim 1, wherein said tension means includes a pair of generally parallel pins aligned perpendicular to the movement of the knitted yarn package whereby resistance to movement is provided by the interlacing of the knitted yarn package with respect to the pins.

4. The apparatus according to claim 1, wherein said unravelling assembly includes a plurality of bristles.

5. The apparatus according to claim 4, wherein said drive means includes means for moving said unravelling assembly proportionally to the feed of said textile fabric making machine.

6. The apparatus according to claim 5, wherein the speed of movement of said unravelling assembly is greater than the speed of movement of the yarn ends in the direction of the machine.

7. The apparatus according to claim 5, wherein said drive means includes a chain drive connected to said machine and an elastomeric belt connected between said chain drive and said unravelling assembly.

8. The apparatus according to claim 4, wherein said drive means is operable to move said unravelling assembly in a rotational manner.

9. The apparatus according to claim 8, wherein said unravelling assembly is configured to provide intermittent movement with respect to said yarn ends.

10. The apparatus according to claim 4, wherein said drive means is operable to move said unravelling assembly in a reciprocal manner with respect to said yarn ends.

11. An unravelling assembly for an apparatus for feeding and unravelling a knitted yarn package having a plurality of elastic yarn ends to a textile fabric making machine under substantially uniform and constant tension, said apparatus including takeup means for moving the yarn ends of the package in the direction of the machine and tension means located upstream of said takeup means for providing resistance to the movement of the yarn package in the direction of the machine, said unravelling assembly positioned between said takeup means and said tension means comprising:

(a) a movable support member;

(b) means for attaching said member upstream of the textile fabric making machine and generally perpendicular to the direction of the movement of the yarn ends to said machine; and (c) a plurality of bristles attached to said member for movably engaging the yarn ends prior to the yarn ends being absorbed by the machine;

whereby when attached to said machine, the moving engagement of said bristles with the yarn ends is operable to unravel the knitted yarn package uniformly.

12. The apparatus according to claim 11, wherein the length of said member is substantially greater than its diameter.

13. The apparatus according to claim 11, wherein said means for attaching said member includes a shaft extending through said member and a pair of vertical supports attached to said feeding apparatus and to each end of said shaft.

14. The apparatus according to claim 13, wherein said bristles are a plurality of nylon filaments.

15. The apparatus according to claim 13, wherein said bristles are radially mounted around said member.

16. The apparatus according to claim 15, wherein said bristles are arranged in at least one row generally extending from one end of said member to the other end.

17. The apparatus according to claim 16, wherein said row is helix-shaped.

18. An apparatus for feeding and unravelling a knitted yarn package having a plurality of elastic yarn ends to a textile fabric making machine under substantially uniform and constant tension comprising:

(a) takeup means for moving the yarn ends of the package in the direction of the machine;

(b) tension means located upstream of said takeup means for providing resistance to the movement of the yarn package in the direction of the machine;

(c) an unravelling assembly positioned between said takeup means and said tension means for movably engaging the yarn ends, said assembly including a plurality of bristles for engaging the yarn ends prior to the yarn ends being absorbed by the machine; and (d) drive means connected to said unravelling assembly for moving said unravelling assembly with respect to said yarn ends;

whereby the moving engagement of said bristles with the yarn ends is operable to unravel the knitted yarn package uniformly.

19. The apparatus according to claim 18, wherein said takeup means includes at least one pair of nip rolls connected to and driven by said textile fabric making machine.

20. The apparatus according to claim 18, wherein said tension means includes a pair of generally parallel pins aligned perpendicular to the movement of the knitted yarn package whereby resistance to movement is provided by the interlacing of the knitted yarn package with respect to the pins.

21. The apparatus according to claim 20, wherein said drive means is operable to move said unravelling assembly in a direction opposite to the direction of movement of the yarn ends towards the machine.

22. The apparatus according to claim 20, wherein said drive means includes means for moving said unravelling assembly proportionally to the feed of said textile fabric making machine.

23. The apparatus according to claim 22, wherein the speed of movement of said unravelling assembly is greater than the speed of movement of the yarn ends in the direction of the machine.

24. The apparatus according to claim 22, wherein said drive means includes a chain drive connected to said machine and an elastomeric belt connected between said chain drive and said unravelling assembly.

25. The apparatus according to claim 20, wherein said drive means is operable to move said unravelling assembly in a rotational manner.

26. The apparatus according to claim 25, wherein said unravelling assembly is configured to provide intermittent movement with respect to said yarn ends.

27. The apparatus according to claim 20, wherein said drive means is operable to move said unravelling assembly in a reciprocal manner with respect to said yarn ends.

28. The apparatus according to claim 18, wherein said unravelling assembly includes a generally cylindrical member for supporting said bristles and means for attaching said member upstream of the textile fabric making machine and generally perpendicular to the direction of the movement of the yarn ends to said machine.

29. The apparatus according to claim 28, wherein the length of said member is substantially greater than its diameter.

30. The apparatus according to claim 28, wherein said means for attaching said member includes a shaft extending through said member and a pair of vertical supports attached to said feeding apparatus and to each end of said shaft.

31. The apparatus according to claim 30, wherein said bristles are a plurality of nylon filaments.

32. The apparatus according to claim 30, wherein said bristles are radially mounted around said generally cylindrical member.

33. The apparatus according to claim 32, wherein said bristles are arranged in at least one row generally extending from one end of said cylindrical member to the other end.

34. The apparatus according to claim 33, wherein said row is helix-shaped.

* * * * *